US009790450B2

(12) United States Patent
Iwasaki et al.

(10) Patent No.: US 9,790,450 B2
(45) Date of Patent: Oct. 17, 2017

(54) LUBRICATING OIL COMPOSITION FOR ENGINE MADE OF ALUMINUM ALLOY AND LUBRICATION METHOD

(71) Applicant: IDEMITSU KOSAN CO., LTD., Chiyoda-ku (JP)

(72) Inventors: Junya Iwasaki, Ichihara (JP); Yasunori Shimizu, Ichihara (JP); Yoriyuki Takashima, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/385,874

(22) PCT Filed: Mar. 12, 2013

(86) PCT No.: PCT/JP2013/056776

§ 371 (c)(1),
(2) Date: Sep. 17, 2014

(87) PCT Pub. No.: WO2013/141077

PCT Pub. Date: Sep. 26, 2013

(65) Prior Publication Data

US 2015/0072907 A1 Mar. 12, 2015

(30) Foreign Application Priority Data

| | | |
|---|---|---|
| Mar. 21, 2012 | (JP) | 2012-064125 |
| Mar. 21, 2012 | (JP) | 2012-064131 |
| Mar. 21, 2012 | (JP) | 2012-064134 |
| Jan. 17, 2013 | (JP) | 2013-006613 |
| Jan. 17, 2013 | (JP) | 2013-006614 |
| Jan. 17, 2013 | (JP) | 2013-006615 |

(51) Int. Cl.

| | |
|---|---|
| ***C10M 161/00*** | (2006.01) |
| ***C10M 141/08*** | (2006.01) |
| ***C10M 141/12*** | (2006.01) |

(52) U.S. Cl.

CPC ..... *C10M 161/00* (2013.01); *C10M 141/08* (2013.01); *C10M 141/12* (2013.01); *C10M 2203/1025* (2013.01); *C10M 2207/026* (2013.01); *C10M 2207/262* (2013.01); *C10M 2215/064* (2013.01); *C10M 2215/086* (2013.01); *C10M 2215/223* (2013.01); *C10M 2215/28* (2013.01); *C10M 2219/102* (2013.01); *C10M 2219/104* (2013.01); *C10M 2223/045* (2013.01); *C10M 2227/00* (2013.01); *C10M 2229/02* (2013.01); *C10N 2230/06* (2013.01); *C10N 2230/42* (2013.01); *C10N 2230/43* (2013.01); *C10N 2230/45* (2013.01); *C10N 2240/10* (2013.01); *C10N 2260/14* (2013.01)

(58) Field of Classification Search

CPC C10M 161/00; C10M 141/08; C10M 141/12; C10M 2203/1025; C10M 2207/026; C10M 2207/262; C10M 2215/064; C10M 2215/086; C10M 2215/223; C10M 2215/28; C10M 2219/102; C10M 2219/104; C10M 2223/045; C10M 2227/00; C10M 2229/02; C10N 2230/06; C10N 2230/42; C10N 2230/43; C10N 2230/45; C10N 2240/10; C10N 2260/14

See application file for complete search history.

(56) References Cited

U.S. PATENT DOCUMENTS

| | | | | |
|---|---|---|---|---|
| 8,153,565 | B2 * | 4/2012 | Tipton | C10M 141/10 508/192 |
| 2006/0105921 | A1 | 5/2006 | Arimoto et al. | |
| 2013/0005624 | A1 | 1/2013 | Kamano et al. | |

FOREIGN PATENT DOCUMENTS

| | | | |
|---|---|---|---|
| CN | 1733970 | A | 2/2006 |
| EP | 0 391 649 | A2 | 10/1990 |
| EP | 0 391 649 | B1 | 5/1995 |
| EP | 2 546 324 | A1 | 1/2013 |
| JP | 3 47897 | | 2/1991 |
| JP | 5 70785 | | 3/1993 |
| JP | 2001-49280 | | 2/2001 |
| JP | 2002-356753 | | 12/2002 |
| JP | 2003-041283 | | 2/2003 |
| JP | 2004-149762 | | 5/2004 |
| JP | 2004-155873 | | 6/2004 |
| JP | 2005-263830 | | 9/2005 |
| JP | 2009-108157 | | 5/2009 |
| JP | 2010 528155 | | 8/2010 |
| JP | 2011 190331 | | 9/2011 |

(Continued)

OTHER PUBLICATIONS

U.S. Appl. No. 14/385,874, filed Sep. 17, 2014, Iwasaki, et al.

(Continued)

*Primary Examiner* — Cephia D Toomer

(74) *Attorney, Agent, or Firm* — Oblon, McClelland, Maier & Neustadt, L.L.P.

(57) ABSTRACT

Lubricating oil compositions may include a base oil, a succinimide compound, and a thioheterocyclic compound. Such compositions may have a sulfur content of 0.10 mass % to 1.00 mass % based on a total amount of the composition. A phosphorus content represented by P in mass % and a sulfated ash content represented by M in mass %, based on the total amount of such compositions, may satisfy any of conditions A to C: condition A: $P<0.03$, and $M<0.3$; condition B: $P<0.03$ and $0.3\leq M\leq 0.6$; and condition C: $0.03\leq P\leq 0.06$ and $M<0.3$.

10 Claims, No Drawings

(56) References Cited

FOREIGN PATENT DOCUMENTS

| | | | |
|---|---|---|---|
| WO | WO 2008/147701 | A1 | 12/2008 |
| WO | WO 2011/111795 | A1 | 9/2011 |
| WO | 2013 018907 | | 2/2013 |

OTHER PUBLICATIONS

U.S. Appl. No. 14/385,572, filed Sep. 16, 2014, Shimizu, et al.
International Search Report dated Jun. 11, 2013 in PCT/JP13/056776 Filed Mar. 12, 2013.
Extended European Search Report dated Oct. 21, 2015 in Patent Application No. 13764396.1.
Combined Chinese Office Action and Search Report issued Oct. 10, 2015 in Patent Application No. 201380014986.1 (with English Translation of Categories of Cited Documents).
Office Action dated Jun. 28, 2016, in Japanese Patent Application No. 2013-006615.
Office Action dated Jun. 28, 2016, in Japanese Patent Application No. 2013-006614.
Office Action dated Jun. 28, 2016, in Japanese Patent Application No. 2013-006613.

* cited by examiner

LUBRICATING OIL COMPOSITION FOR ENGINE MADE OF ALUMINUM ALLOY AND LUBRICATION METHOD

TECHNICAL FIELD

The present invention relates to a lubricating oil composition for an engine made of an aluminum alloy and to a lubrication method employing the composition. More specifically, the invention relates to a lubricating oil composition for an engine made of an aluminum alloy useful for use in internal combustion engines such as gasoline engines, diesel engines, and gas engines, and to a lubrication method employing the composition.

BACKGROUND ART

In recent years, for the purpose of reducing environmental loads, strict regulations against exhaust gases have been successively introduced in the automobile industry. The exhaust gases contain, in addition to carbon dioxide ($CO_2$) as a global worming substance, various harmful substances such as particulate matters (PM), hydrocarbons (HC), carbon monoxide (CO) and nitrogen oxides ($NO_x$). Among these substances, very strict regulation values have been imposed on PM and $NO_x$. As the measure for reducing an amount of these substances discharged, gasoline automobiles are provided with a three-way catalyst, whereas diesel automobiles are provided with a diesel particulate filter (DPF). The exhaust gases are cleaned by passing through these members, and then discharged into atmospheric air.

Meanwhile, it has recently reported that active sites of the three-way catalyst tend to be poisoned with phosphorus components in engine oils to thereby cause deterioration in a catalyst performance thereof, and that ash derived from metal components is deposited on the DPF to thereby reduce the service life of the DPF. At present, in the ILSAC Standard and the JASO Standard as standards for engine oils, the upper limits of the phosphorus content and ash content in engine oils have been established, and the engine oils having lower contents of these substances have now been developed.

In recent years, from the viewpoint of improving fuel consumption, parts of an engine or a transmission are formed of a nonferrous metal material for reducing the weight thereof. Among nonferrous metal materials, an aluminum alloy, in particular, an Al—Si alloy, has been frequently employed. However, conventional engine oils contain an anti-wear agent such as zinc dithiophosphate (ZnDTP), which is intended to mainly induce reaction for forming a coating film on Fe. Therefore, there is concern about deterioration of wear resistance of such an oil with respect to aluminum materials such as an Al—Si alloy.

Therefore, studies have been conducted to provide an anti-wear agent suitable for aluminum materials, as disclosed in, for example, Patent Document 1.

PRIOR ART DOCUMENTS

Patent Documents

Patent Document 1: JP 2010-528155A

SUMMARY OF THE INVENTION

Problems to be Solved by the Invention

However, such anti-wear agents have failed to exhibit a sufficient effect, unless they are used in combination with ZnDTP having a large phosphorus content. Therefore, there still remains such a problem that conventional engine oils have an adverse effect on an exhaust gas post-treatment device. Thus, there is strong demand for a lubricating oil composition for engines which can exhibit excellent wear resistance with respect to aluminum materials even with a reduced phosphorus content or without any phosphorus content therein.

Under such circumstances, an object of the present invention is to provide a lubricating oil composition for an engine made of aluminum alloy, which composition imparts excellent wear resistance to the sliding part and can considerably reduce the high-phosphorus ZnDTP content and the metallic detergent content in an engine having a sliding part formed of aluminum alloy, while excellent wear resistance to aluminum alloy is maintained. Another object is to provide to a lubrication method employing the composition.

Means for Solving the Problems

The present inventors have carried out extensive studies, and have found that the aforementioned objects can be attained by use of a succinimide compound in combination with a specific thioheterocyclic compound. The present invention has been accomplished on the basis of this finding.

Accordingly, the present invention provides the following.

[1] A lubricating oil composition for an engine made of aluminum alloy comprising a base oil, a succinimide compound, and a thioheterocyclic compound represented by the following formula (I):

[F1]

$$(R^1)_k—(S)_m\text{-}A_S\text{-}(S)_n—(R^2)_l \quad (I)$$

(wherein As represents a thioheterocycle; each of $R^1$ and $R^2$ independently represents a hydrogen atom, an amino group, a C1 to C50 hydrocarbyl group selected from among an alkyl group, a cycloalkyl group, an alkenyl group, a cycloalkenyl group, and an aryl group, or, in the case of a hydrocarbyl group, a C1 to C50 heteroatom-containing group having an atom selected from among an oxygen atom, a nitrogen atom, and a sulfur atom, in the hydrocarbyl group; and each of k, l, m, and n is an integer of 0 to 5), wherein the composition has a sulfur content of 0.10 mass % to 1.00 mass % based on the total amount of the composition, and a phosphorus content (P mass %) and a sulfated ash content (M mass %), based on the total amount of the composition, satisfying any of the following conditions A to C:

condition A: $P<0.03$, and $M<0.3$;

condition B: $P<0.03$, and $0.3\leq M\leq 0.6$; and condition C: $0.03\leq P\leq 0.06$, and $M<0.3$.

[2] The lubricating oil composition for an engine made of aluminum alloy as described in [1], wherein the nitrogen content attributed to the succinimide compound is 0.08 mass % to 0.40 mass %, based on the total amount of the composition.

[3] The lubricating oil composition for an engine made of aluminum alloy as described in [2], wherein the succinimide compound includes a boron derivative thereof.

[4] The lubricating oil composition for an engine made of aluminum alloy as described in any of [1] to [3], wherein, in formula (I), the case where both m and n are 0 is excluded.

[5] The lubricating oil composition for an engine made of aluminum alloy as described in any of [1] to [4], wherein, in formula (I), the thioheterocycle is a thiadiazole ring.

[6] The lubricating oil composition for an engine made of aluminum alloy as described in [5], wherein the thiadiazole ring is a 1,3,4-thiadiazole ring to which sulfur atoms are bonded to the 2-position and the 5-position of the ring.

[7] The lubricating oil composition for an engine made of aluminum alloy as described in [6], wherein one sulfur atom is bonded to each of the 2-position and the 5-position of the 1,3,4-thiadiazole ring.

[8] A method for lubricating an engine made of aluminum alloy, the engine having a sliding part made of aluminum alloy, characterized in that the method comprises applying, to the sliding part, an aluminum alloy engine lubricating oil composition as recited in any of [1] to [7].

Effects of the Invention

According to the present invention, there is provided a lubricating oil composition for an engine made of aluminum alloy, which composition imparts excellent wear resistance to the sliding part and can considerably reduce the high-phosphorus ZnDTP content and the metallic detergent content in an engine having a sliding part formed of aluminum alloy, while excellent wear resistance to aluminum alloy is maintained. The invention also provides a lubrication method employing the composition.

MODE FOR CARRYING OUT THE INVENTION

A characteristic feature of the present invention resides in that the lubricating oil composition for an engine made of aluminum alloy (hereinafter may be referred to simply as a "lubricating oil composition") contains a base oil, a succinimide compound, and a thioheterocyclic compound represented by the following formula (I):

[F2]

$$(R^1)_k—(S)_m\text{-}A_S\text{-}(S)_n—(R^2)_l \quad (I)$$

(wherein As represents a thioheterocycle; each of $R^1$ and $R^2$ independently represents a hydrogen atom, an amino group, a C1 to C50 hydrocarbyl group selected from among an alkyl group, a cycloalkyl group, an alkenyl group, a cycloalkenyl group, and an aryl group, or, in the case of a hydrocarbyl group, a C1 to C50 heteroatom-containing group having an atom selected from among an oxygen atom, a nitrogen atom, and a sulfur atom, in the hydrocarbyl group; and each of k, l, m, and n is an integer of 0 to 5), wherein the composition has a sulfur content of 0.10 mass % to 1.00 mass % based on the total amount of the composition, and a phosphorus content (P mass %) and a sulfated ash content (M mass %), based on the total amount of the composition, satisfying any of the following conditions A to C:

condition A: $P<0.03$ and $M<0.3$;

condition B: $P<0.03$ and $0.3\leq M\leq 0.6$; and condition C: $0.03\leq P\leq 0.06$ and $M<0.3$.

The aforementioned elements will next be described in detail.

[Base Oil]

No particular limitation is imposed on the base oil employed in the present invention, and any of the conventionally used as base oils for lubricating oil including mineral oil and synthetic oil may be appropriately selected.

Examples of the mineral oil include a mineral oil produced through subjecting a lubricating oil fraction which has been obtained through distillation of crude oil at ambient pressure and distillation of the residue under reduced pressure, to at least one treatment selected from among solvent deasphalting, solvent extraction, hydro-cracking, solvent dewaxing, and hydro-refining. Another example is a mineral produced through isomerization of wax or isomerization of GTL wax.

Examples of the synthetic oil include polybutene, polyolefins [α-olefin homopolymer and copolymers (e.g., ethylene-α-olefin copolymer)], esters (e.g., polyol ester, dibasic acid ester, and phosphate ester), ethers (e.g., polyphenyl ether), polyglycols, alkylbenzenes, and alkylnaphthalenes. Among these synthetic oils, polyolefins and polyol ester are preferred.

In the present invention, the aforementioned mineral oils may be used singly, or in combinations of two or more species, as base oil. Also, the aforementioned synthetic oils may be used singly, or in combinations of two or more species. Alternatively, one or more members of the mineral oils and one or more members of the synthetic oils may be used in combination.

No particular limitation is imposed on the viscosity of the base oil, but the kinematic viscosity, as measured at 100° C., is preferably 1.5 $mm^2/s$ to 50 $mm^2/s$, more preferably 3 $mm^2/s$ to 30 $mm^2/s$, still more preferably 3 $mm^2/s$ to 15 $mm^2/s$.

When the kinematic viscosity, as measured at 100° C., is 1.5 $mm^2/s$ or higher, vaporization loss is suppressed, whereas when the kinematic viscosity is 50 $mm^2/s$ or lower, power loss attributable to viscous resistance is suppressed, to thereby improve fuel consumption.

The base oil which is preferably used in the invention has a % $C_A$ obtained through ring analysis of 3.0 or less and a sulfur content of 50 ppm by mass or less. The "% $C_A$ obtained through ring analysis" refers to an aromatic content (percentage) calculated through the ring analysis n-d-M method. The sulfur content is measured according to the JIS K 2541.

When the base oil has a % $C_A$ of 3.0 or lower and a sulfur content of 50 ppm by mass or less, the lubricating oil composition employing the base oil exhibits excellent stability against oxidation, and rise in acid value and sludge formation can be suppressed. The % $C_A$ is more preferably 1.0 or lower, still more preferably 0.5 or lower, and the sulfur content is more preferably 30 ppm by mass or less.

The base oil preferably has a viscosity index of 70 or higher, more preferably 90 or higher, still more preferably 100 or higher. When the base oil has a viscosity index of 70 or higher, variation in viscosity of the base oil for temperature change is suppressed.

[Succinimide Compound]

The succinimide compound employed in the present invention is, for example, a mono-type succinimide compound represented by the following formula (II), or a bis-type succinimide compound represented by the following formula (III).

[F3]

(II)

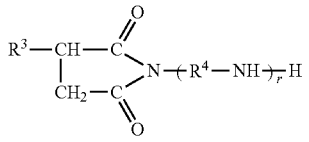

-continued (III)

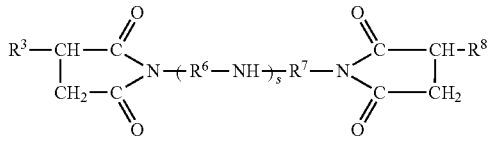

In the above formulas (II) and (III), each of $R^3$, $R^5$, and $R^8$ is an alkenyl group or an alkyl group having a number average molecular weight of 500 to 4,000. $R^5$ and $R^8$ may be identical to or different from each other. The number average molecular weight of $R^3$, $R^5$, and $R^8$ is preferably 1,000 to 4,000.

When the number average molecular weight of $R^3$, $R^5$, and $R^8$ is 500 or more, favorable solubility in base oil is ensured, whereas when the molecular weight is 4,000 or less, dispersibility can be maintained.

Also, each of $R^4$, $R^6$, and $R^7$ is a C2 to C5 alkylene group. $R^6$ and $R^7$ may be identical to or different from each other. The "r" is an integer of 1 to 10, and the "s" is 0 or an integer of 1 to 10. The r is preferably 2 to 5, more preferably 3 or 4. When r is 1 or more, favorable dispersibility is ensured, whereas when r is 10 or less, high solubility in base oil is ensured.

In formula (III), s is preferably 1 to 4, more preferably 2 or 3. When s falls within the range, favorable dispersibility and solubility in base oil can be attained.

Examples of the alkenyl group include a polybutenyl group, a polyisobutenyl group, and an ethylene-propylene copolymer. Examples of the alkyl group include hydrogenation products of any of the alkenyl groups. Typical examples of preferred alkenyl groups include a polybutenyl group and a polyisobutenyl group. The polybutenyl group is formed by polymerizing a mixture of 1-butene and isobutene, or high-purity isobutene. Typical examples of preferred alkyl groups include hydrogenation products of the polybutenyl group or the polyisobutenyl group.

Examples of preferably employed succinimide compounds include alkenylsuccinimide compounds such as polybutenylsuccinimide, and alkylsuccinimide compounds.

Generally, the alkenylsuccinimide compounds and alkylsuccinimide compounds may be produced through reaction of polyamine with alkenylsuccinic acid anhydride; i.e., a reaction product of polyolefin and maleic anhydride, or alkylsuccinic acid anhydride; i.e., a hydrogenation product of the alkenylsuccinic acid anhydride. The aforementioned mono-type type succinimide compound and bis-type succinimide compound may be produced by modifying the ratio of the amount of the alkenylsuccinic anhydride or alkylsuccinic anhydride to the amount of polyamine in the reaction.

The olefin monomer for forming the polyolefin may be one or more species of C2 to C8 α-olefins. Among them, a mixture of isobutene and 1-butene is preferably used.

Examples of the polyamine include monoalkylenediamines such as ethylenediamine, propylenediamine, butylenediamine, and pentylenediamine; polyalkylenepolyamines such as diethylenetriamine, triethylenetetramine, tetraethylenepentamine, pentaethylenehexamine, di(methylethylene)triamine, dibutylenetriamine, tributylenetetramine, and pentapentylenehexamine; and piperazine derivatives such as aminoethylpiperazine.

Other than the aforementioned alkenyl- or alkylsuccinimide compounds, products thereof modified with a boron derivative and/or an organic acid may also be used as the succinimide compound.

The boron derivatives of the alkenyl- or alkylsuccinimide compounds may be produced through a known method. In one mode of production, the polyolefin is reacted with maleic anhydride, to thereby form an alkenylsuccinic anhydride, which is further reacted with an intermediate obtained through reaction of the polyamine with a boron compound; e.g., boron oxide, boron halide, boric acid, boric anhydride, borate ester, or ammonium boronate, to thereby yield an imidation product.

No particular limitation is imposed on the boron content of the boron derivative, but the boron content is generally 0.05 mass % to 5 mass %, preferably 0.1 mass % to 3 mass %.

The amount of the succinimide compound, as reduced to the nitrogen content attributed to the succinimide compound, is preferably 0.08 mass % to 0.40 mass %, based on the total amount of the lubricating oil composition. When the nitrogen content falls within the range, high-temperature detergency of the lubricating oil composition can be sufficiently improved, and low-temperature flowability is considerably improved. The nitrogen content is more preferably 0.08 mass % to 0.35 mass %.

In the case where the succinimide compound includes a boron derivative thereof, the boron content attributed to the boron derivative is preferably 0.020 mass % to 0.3 mass %, based on the total amount of the composition. When the boron content falls within the range, excellent detergency and dispersibility can be attained. The boron content is more preferably 0.025 mass % to 0.25 mass %.

In this case, the ratio by mass (B/N) of the boron content to the nitrogen content is preferably 0.07 to 1.0, more preferably 0.09 to 0.95.

[Thioheterocyclic Compound]

The thioheterocyclic compound employed in the present invention is represented by the following formula (I).

[F4]

$$(R^1)_k—(S)_m\text{-}A_S\text{-}(S)_n—(R^2)_l \quad (I)$$

In formula (I), As represents a thioheterocycle; each of $R^1$ and $R^2$ independently represents a hydrogen atom, an amino group, a C1 to C50 hydrocarbyl group selected from among an alkyl group, a cycloalkyl group, an alkenyl group, a cycloalkenyl group, and an aryl group, or, in the case of a hydrocarbyl group, a C1 to C50 heteroatom-containing group having an atom selected from among an oxygen atom, a nitrogen atom, and a sulfur atom, in the hydrocarbyl group; and each of k, l, m, and n is an integer of 0 to 5.

In formula (I), the case where at least one of m and n is not 0; i.e., the case where one or more sulfur atoms are bonded to at least one side of the thioheterocycle, is preferred, from the viewpoint of enhancement of wear resistance. More preferably, these sulfur atoms are bonded to both sides of the thioheterocycle.

Examples of the thioheterocycle include a benzothiophene ring, a naphthothiophene ring, a dibenzothiophene ring, a thienothiophene ring, a dithienobenzene ring, a thiazole ring, a thiophene ring, a thiazoline ring, a benzothiazole ring, a naphthothiazole ring, an isothiazole ring, a benzoisothiazole ring, a naphthoisothiazole ring, a thiadiazole ring, a phenothiazine ring, a phenoxathiin ring, a dithianaphthalene ring, a thianthrene ring, a thioxanthene ring, and a bithiophene ring. These rings may be substituted.

Among them, a thiadiazole ring is preferably employed, from the viewpoint of enhancement of wear resistance.

The thiadiazole ring is preferably a 1,3,4-thiadiazole ring. The thioheterocyclic compound of the present invention preferably includes a structure in which sulfur atoms are bonded to the 2, and 5-positions of the 1,3,4-thiadiazole ring, from the viewpoint of enhancement of wear resistance.

Furthermore, the thioheterocyclic compound of the present invention preferably includes a structure in which one sulfur atom is bonded to each of the 2, and 5-positions of the 1,3,4-thiadiazole ring, from the viewpoint of enhancement of wear resistance.

In formula (I), the alkyl group $R^1$ or $R^2$ is preferably a C1 to C30 alkyl group, more preferably a C1 to C24 alkyl group. Specific examples of the alkyl group include n-butyl, isobutyl, sec-butyl, tert-butyl, hexyls, octyls, decyls, dodecyls, tetradecyls, hexadecyls, octadecyls, and icosyls. The alkyl group may be substituted with an aromatic group; such as benzyl or phenethyl.

The cycloalkyl group $R^1$ or $R^2$ is preferably a C3 to C30 cycloalkyl group, more preferably a C3 to C24 cycloalkyl group. Specific examples of the cycloalkyl group include cyclopropyl, cyclopentyl, cyclohexyl, methylcyclopentyl, dimethylcyclopentyl, methylethylcyclopentyl, diethylcyclopentyl, methylcyclohexyl, dimethylcyclohexyl, methylethylcyclohexyl, and diethylcyclohexyl. The cycloalkyl group may be substituted with an aromatic group; such as phenylcyclopentyl or phenylcyclohexyl.

The alkenyl group $R^1$ or $R^2$ is preferably a C2 to C30 alkenyl group, more preferably a C2 to C24 alkenyl group. Specific examples of the alkenyl group include vinyl, aryl, 1-butenyl, 2-butenyl, 3-butenyl, 1-methylvinyl, 1-methylaryl, 1,1-dimethylaryl, 2-methylaryl, noneyl, decenyl, and octadecenyl. The alkenyl group may be substituted with an aromatic group.

The cycloalkenyl group $R^1$ or $R^2$ is preferably a C3 to C30 cycloalkenyl group, more preferably a C3 to C24 cycloalkenyl group. Specific examples of the cycloalkenyl group include cyclobutenyl and methylcyclobutenyl. The cycloalkenyl group may be substituted with an aromatic group.

The aryl group $R^1$ or $R^2$ is a C6 to C30 aryl group, more preferably a C6 to C24 aryl group. Specific examples of the aryl group include phenyl, tolyl, xylyl, naphthyl, butylphenyl, octylphenyl, and nonylphenyl.

Examples of the thioheterocyclic compound represented by formula (I) include compounds represented by the following formulas.

[F5]

(I-a)

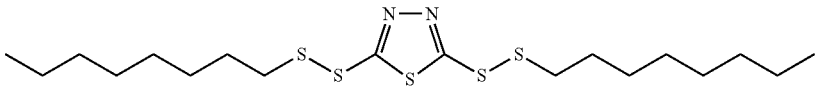

[F6]

(I-b)

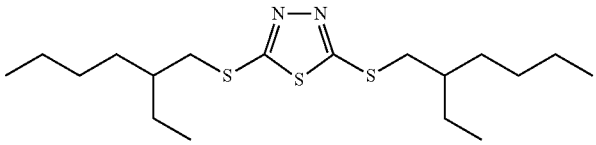

[F7]

(I-c)

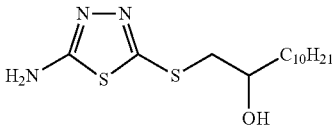

[F8]

(I-d)

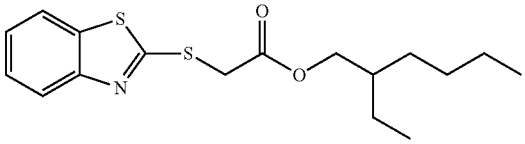

[F9]

(I-e)

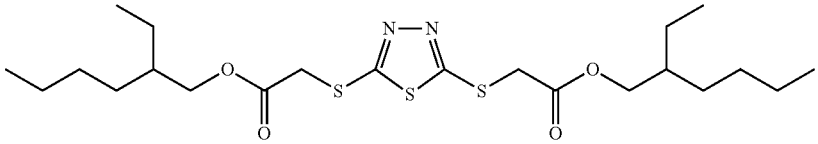

-continued

[F10]

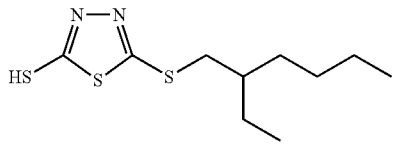

(I-f)

In addition to the above compounds, examples of the thioheterocyclic compound represented by formula (I) include 2-(2-ethylhexylthio)thiazole, 2,4-bis(2-ethylhexylthio)thiazole, 2,5-bis(t-nonylthio)-1,3,4-thiadiazole, 2,5-bis(dimethylhexylthio)-1,3,4-thiadiazole, 2,5-bis(octadecenylthio)-1,3,4-thiadiazole, 2,5-bis(methylhexadecenylthio)-1,3,4-thiadiazole, 2-octylthio-thiazoline, 2-(2-ethylhexylthio)benzothiazole, 2-(2-ethylhexylthio)thiophene, 2,4-bis(2-ethylhexylthio)thiophene, 2-(2-ethylhexylthio)thiazoline, 2,5-bis(2-hydroxyoctadecylthio)-1,3,4-thiadiazole, 2,5-bis(n-octoxycarbonylmethylthio)-1,3,4-thiadiazole, 2-mercapto-5-(2-ethylhexylthio)-1,3,4-thiadiazole, 2-mercapto-5-(t-nonylthio)-1,3,4-thiadiazole, 2-(2-ethylhexyldithio)thiazole, 2,4-bis(2-ethylhexyldithio)thiazole, 2,5-bis(t-nonyldithio)-1,3,4-thiadiazole, 2,5-bis(dimethylhexyldithio)-1,3,4-thiadiazole, 2,5-bis(octadecenyldithio)-1,3,4-thiadiazole, 2,5-bis(methylhexadecenyldithio)-1,3,4-thiadiazole, 2-octyldithio-thiazoline, 2-(2-ethylhexyldithio)benzothiazole, 2-(2-ethylhexyldithio)thiophene, 2,4-bis(2-ethylhexyldithio)thiophene, 2-(2-ethylhexyldithio)thiazoline, 2,5-bis(2-hydroxyoctadecyldithio)-1,3,4-thiadiazole, 2,5-bis(n-octoxycarbonylmethyldithio)-1,3,4-thiadiazole, 2-mercapto-5-(2-ethylhexyldithio)-1,3,4-thiadiazole, 2-mercapto-5-(t-nonyldithio)-1,3,4-thiadiazole, 2-(2-ethylhexylamino)thiazole, 2,4-bis(2-ethylhexylamino)thiazole, 2,5-bis(t-nonylamino)-1,3,4-thiadiazole, 2,5-bis(dimethylhexylamino)-1,3,4-thiadiazole, 2,5-bis(octadecenylamino)-1,3,4-thiadiazole, 2,5-bis(methylhexadecenylamino)-1,3,4-thiadiazole, 2-octylaminothiazoline, 2-(2-ethylhexylamino)benzothiazole, 2-(2-ethylhexylamino)thiophene, 2,4-bis(2-ethylhexylamino)thiophene, 2-(2-ethylhexylamino)thiazoline, 2,5-bis(2-hydroxyoctadecylamino)-1,3,4-thiadiazole, 2,5-bis(n-octoxycarbonylmethylamino)-1,3,4-thiadiazole, 2-amino-5-(2-ethylhexylamino)-1,3,4-thiadiazole, 2-amino-5-(t-nonylamino)-1,3,4-thiadiazole, 2-(2-ethylhexyl)thiazole, 2,4-bis(2-ethylhexyl)thiazole, 2,5-bis(t-nonyl)-1,3,4-thiadiazole, 2,5-bis(dimethylhexyl)-1,3,4-thiadiazole, 2,5-bis(octadecenyl)-1,3,4-thiadiazole, 2,5-bis(methylhexadecenyl)-1,3,4-thiadiazole, 2-octyl-thiazoline, 2-(2-ethylhexyl)benzothiazole, 2-(2-ethylhexyl)thiophene, 2,4-bis(2-ethylhexyl)thiophene, 2-(2-ethylhexyl)thiazoline, 2,5-bis(2-hydroxyoctadecyl)-1,3,4-thiadiazole, 2,5-bis(n-octoxycarbonylmethyl)-1,3,4-thiadiazole, 2-(2-ethylhexyl)-1,3,4-thiadiazole, and 2-(t-nonyl)-1,3,4-thiadiazole.

The lubricating oil composition of the present invention has a sulfur content of 0.10 mass % to 1.00 mass % based on the total amount of the composition. When the sulfur content is less than 0.10 mass %, wear resistance is insufficient, whereas when the sulfur content is in excess of 1.00 mass %, corrosion may occur. Thus, the sulfur content is preferably 0.12 mass % 0.90 mass % based on the total amount of the composition, more preferably 0.15 mass % to 0.85 mass %.

The lubricating oil composition of the present invention essentially has a phosphorus content (P mass %) and a sulfated ash content (M mass %), based on the total amount of the composition, satisfying any of the following conditions A to C.

[Condition A]

Condition A of the present invention is as follows: $P<0.03$, and $M<0.3$. That is, the phosphorus content is essentially less than 0.03 mass %, and the sulfated ash content is essentially less than 0.3 mass %, based on the total amount of the composition.

When the phosphorus content of the composition is less than 0.03 mass %, poisoning of active sites of a three-way catalyst can be suppressed, so that the catalyst service life can be prolonged. Thus, the phosphorus content is preferably 0.02 mass % or less, more preferably 0.01 mass % or less.

Meanwhile, when the sulfated ash content of the composition is less than 0.3 mass %, deposition, on DPF, of an ash component originating from metallic components is suppressed, thereby prolonging the service life. Thus, the sulfated ash content of the composition is preferably 0.25 mass % or less, more preferably 0.20 mass % or less, particularly preferably 0.15 mass % or less.

[Condition B]

Condition B of the present invention is as follows: $P<0.03$, and $0.3\leq M\leq 0.6$. That is, the phosphorus content is essentially less than 0.03 mass %, and the sulfated ash content is essentially 0.3 mass % to 0.6 mass %, based on the total amount of the composition.

When the phosphorus content of the composition is less than 0.03 mass %, poisoning of active sites of a three-way catalyst can be suppressed, so that the catalyst service life can be prolonged. Thus, the phosphorus content is preferably 0.02 mass % or less, more preferably 0.01 mass % or less.

Meanwhile, when the sulfated ash content of the composition is 0.3 mass % or more, detergency which is required for a lubricating oil for internal combustion engine can be further enhanced, whereas when the sulfated ash content is 0.6 mass % or less, deposition, on DPF, of an ash component originating from metallic components is suppressed, thereby prolonging the service life. Thus, the sulfated ash content of the composition is preferably 0.3 mass % to 0.5 mass %, more preferably 0.3 mass % to 0.4 mass %.

[Condition C]

Condition C of the present invention is as follows: $0.03\leq P\leq 0.06$, and $M<0.3$. That is, the phosphorus content is essentially 0.03 mass % to 0.06 mass %, and the sulfated ash content is essentially less than 0.3 mass %, based on the total amount of the composition.

When the phosphorus content of the composition is 0.03 mass % or more, wear resistance which is required for a lubricating oil for engine can be further enhanced, whereas when the phosphorus content is 0.06 mass % or less, poisoning of active sites of a three-way catalyst can be suppressed, so that the catalyst service life can be prolonged. Thus, the phosphorus content is preferably 0.03 mass % to 0.055 mass %, more preferably 0.03 mass to 0.050 mass %.

Meanwhile, when the sulfated ash content of the composition is less than 0.3 mass %, deposition, on DPF, of an ash component originating from metallic components is suppressed, thereby prolonging the service life. Thus, the sulfated ash content of the composition is preferably 0.25 mass % or less, more preferably 0.20 mass % or less, particularly preferably 0.15 mass % or less.

The phosphorus content of the composition may be tuned by modifying the amount of the phosphorus anti-wear agent. Typical examples of the phosphorus anti-wear agent include phosphate esters and thiophosphate esters. Of these, phosphite esters, alkyl hydrogenphosphite, and phosphate ester amine salts are preferred. In the present invention, zinc dithiophosphate (ZnDTP) is particularly preferred.

The sulfated ash content of the composition may be tuned by appropriately choosing the amount of the below-mentioned metallic detergent.

So long as the effects of the present invention are not impaired, the lubricating oil composition of the present invention may further contain known additives. Examples of such additives include an antioxidant, a metallic detergent, a viscosity index improver, a pour point depressant, a metal deactivator, a rust preventive, and a defoaming agent.

The antioxidant is preferably a phosphorus-free antioxidant. Examples include a phenol-based antioxidant, an amine-based antioxidant, a molybdenum-amine complex-based antioxidant, and a sulfur-based antioxidant.

Examples of the phenol-based antioxidant include 4,4'-methylene bis(2,6-di-t-butyl phenol); 4,4'-bis(2,6-di-t-butyl phenol); 4,4'-bis(2-methyl-6-t-butyl phenol); 2,2'-methylene bis(4-ethyl-6-t-butyl phenol); 2,2'-methylene bis(4-methyl-6-t-butyl phenol); 4,4'-butylidene bis(3-methyl-6-t-butyl phenol); 4,4'-isopropylidene bis(2,6-di-t-butyl phenol); 2,2'-methylene bis(4-methyl-6-nonyl phenol); 2,2'-isobutylidene bis(4,6-dimethyl phenol); 2,2'-methylene bis(4-methyl-6-cyclohexyl phenol); 2,6-di-t-butyl-4-methyl phenol; 2,6-di-t-butyl-4-ethyl phenol; 2,4-dimethyl-6-t-butyl phenol; 2,6-di-t-amyl-p-cresol; 2,6-di-t-butyl-4-(N,N'-dimethylaminomethyl phenol); 4,4'-thiobis(2-methyl-6-t-butyl phenol); 4,4'-thiobis(3-methyl-6-t-butyl phenol); 2,2'-thiobis(4-methyl-6-t-butyl phenol); bis(3-methyl-4-hydroxy-5-t-butyl benzyl)sulfide; bis(3,5-di-t-butyl-4-hydroxybenzyl)sulfide; n-octadecyl-3-(4-hydroxy-3,5-di-t-butylphenyl)propionate; and 2,2'-thio[diethyl-bis-3-(3,5-di-t-butyl-4-hydroxyphenyl)propionate].

Among these phenol-based antioxidants, particularly preferred are bisphenol-based antioxidants and ester group-containing phenol-based antioxidants.

Examples of the amine-based antioxidant include monoalkyldiphenylamine-based antioxidants such as monooctyldiphenyl amine and monononyldiphenylamine; dialkyldiphenylamine-based antioxidants such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamine-based antioxidants such as tetrabutyldiphenylamine, tetrahexyldiphenylamine, tetraoctyldiphenylamine and tetranonyldiphenylamine; and α-naphthylamine and phenyl-α-naphthylamine; and alkyl-substituted phenyl-α-naphthylamines such as butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine.

Among them, preferred are dialkyldiphenylamine-based antioxidants and naphthylamine-based antioxidants.

The molybdenum-amine complex-based antioxidant may be a complex formed through reaction of a 6-valent molybdenum compound, specifically, molybdenum trioxide and/or molybdic acid with an amine compound. For example, a compound produced through the production method disclosed in Japanese Patent Application Laid-Open No. 2003-252887 may be used.

No particular limitation is imposed on the amine compound which is reacted with the 6-valent molybdenum compound, and a monoamine, a diamine, a polyamine, and an alkanolamine may be used. Specific examples include alkylamines having a C1 to C30 alkyl group (the alkyl group may be linear or branched), such as methylamine, ethylamine, dimethylamine, diethylamine, methylethylamine, and methylpropylamine; alkenylamines having a C2 to C30 alkenyl group (the alkenyl group may be linear or branched), such as ethenylamine, propenylamine, butenylamine, octenylamine, and oleylamine; alkanolamines having a C1 to C30 alkanol group (the alkanol group may be linear or branched), such as methanolamine, ethanolamine, methanolethanolamine, and methanolpropanolamine; alkylenediamines having a C1 to C30 alkylene group, such as methylenediamine, ethylenediamine, propylenediamine, and butylenediamine; polyamines such as diethylenetriamine, triethylenetetramine, tetraethylenepentamine, and pentaethylenehexamine; compounds formed of any of the monoamines, diamines, and polyamines with a C8 to C20 alkyl group or alkenyl group, such as undecyldiethylamine, undecyldiethanolamine, dodecyldipropanolamine, oleyldiethanolamine, oleylpropylenediamine, and stearyltetraethylenepantamine; heterocyclic compounds such as imidazoline; alkylene oxide adducts or these compounds; and mixtures thereof.

Examples of the molybdenum complex further include succinimide sulfur-containing molybdenum complexes disclosed in Japanese Patent Publication No. Hei 3-22438 and Japanese Patent Application Laid-Open No. 2004-2866. These complex may be produced through the following steps (m) and (n):

(m): a step of reacting an acidic molybdenum compound or a salt thereof with a basic nitrogen compound selected from the group consisting of succinimide, carboxamide, hydrocarbylmonoamine, hydrocarbylpolyamine, a Mannich base, phosphonamide, thiophosphonamide, phosphamide, a dispersant-type viscosity index improver, and a mixture thereof, constantly at about 120° C. or lower, to thereby form a molybdenum complex; and (n) a step of subjecting the product of step (m) to at least one stripping step, or to the stripping step and a sulfurization step, wherein the stripping step and sulfurization step is performed for such a period of time that an isooctane solution of the molybdenum complex having a concentration of 1 g, corresponding to Mo of 0.00025 g exhibits an absorbance less than 0.7 measured by means of a UV-Vis. spectrophotometer with a 1-cm quartz cell at 350 nm, and the reaction mixture is maintained at about 120° C. or lower during the stripping step and sulfurization step.

Alternatively, these molybdenum complexes may be produced through the following steps (o), (p), and (q):

(o) a step of reacting an acidic molybdenum compound or a salt thereof with a basic nitrogen compound selected from the group consisting of succinimide, carboxamide, hydrocarbylmonoamine, hydrocarbylpolyamine, a Mannich base, phosphonamide, thiophosphonamide, phosphamide, a dispersant-type viscosity index improver, and a mixture thereof, constantly at about 120° C. or lower, to thereby form a molybdenum complex;

(p) a step of subjecting the product of step (o) to stripping at about 120° C. or lower; and (q) a step of sulfuring the product of (p) at about 120° C. or lower and a ratio of sulfur and molybdenum of about 1:1 or lower, wherein the sulfurization step is performed for such a period of time that an isooctane solution of the molybdenum complex having a concentration of 1 g, corresponding to Mo of 0.00025 g exhibits an absorbance less than 0.7 measured by means of a UV-Vis. spectrophotometer with a 1-cm quartz cell at 350 nm.

Examples of the sulfur-based antioxidant include phenothiazine, pentaerythritol-tetrakis-(3-laurylthiopropionate), didodecyl sulfide, dioctadecyl sulfide, didodecyl thiodipropionate, dioctadecyl thiodipropionate, dimyristyl thiodipropionate, dodecyloctadecyl thiodipropionate, and 2-mercaptobenzoimidazole.

Among the aforementioned antioxidants, phenol-based antioxidants and amine-based antioxidants are preferred, for the purpose of reducing metallic components and sulfur components. Also, the aforementioned antioxidants may be used singly or in combination of two or more species. From the viewpoint of stability to oxidation, a mixture of one or more phenol-based antioxidant and one or more amine-based antioxidants are preferred.

Generally, the amount of the antioxidant is preferably 0.1 mass % to 5 mass % based on the total amount of composition, more preferably 0.1 mass % to 3 mass %. The amount of the molybdenum complex, as reduced to the molybdenum content, is preferably 10 ppm by mass to 1,000 ppm by mass based on the total amount of the composition, more preferably 30 ppm by mass to 800 ppm by mass, still more preferably 50 ppm by mass to 500 ppm by mass.

The metallic detergent may be any of the alkaline earth metallic detergents generally employed in lubricating oils. Examples of the metallic detergent include an alkaline earth metal sulfonate, an alkaline earth metal phenate, an alkaline earth metal salicylate, and a mixture of two or more members of these.

Examples of the alkaline earth metal sulfonate include alkaline earth metal salts of an alkylaromatic sulfonic acid, produced through sulfonization of an alkylaromatic compound having a molecular weight of 300 to 1,500, preferably 400 to 700, particularly magnesium salts and/or calcium salts thereof. Of these, calcium salts are preferably used.

Examples of the alkaline earth metal phenate include alkaline earth metal salts of an alkylphenol, an alkylphenol sulfide, or an alkylphenol Mannich reaction product, particularly magnesium salts and/or calcium salts thereof. Of these, calcium salts are particularly preferably used.

Examples of the alkaline earth metal salicylate include alkaline earth metal salts of an alkylsalicylic acid, particularly magnesium salts and/or calcium salts thereof. Of these, calcium salts are preferably used.

The alkyl group forming the alkaline earth metallic detergent is preferably a C4 to C30 alkyl group, more preferably a C6 to C18 alkyl group. These alkyl groups may be linear or branched.

Also, these alkyl groups may be any of a primary alkyl group, a secondary alkyl group, and a tertiary alkyl group.

The alkaline earth metal sulfonate, alkaline earth metal phenate, and alkaline earth metal salicylate include a neutral alkaline earth metal sulfonate, a neutral alkaline earth metal phenate, and a neutral alkaline earth metal salicylate, which are produced by reacting the aforementioned alkylaromatic sulfonic acid, alkylphenol, alkylphenol sulfide, alkylphenol Mannich reaction product, alkylsalicylic acid, or the like directly with an alkaline earth metal oxide or an alkaline earth metal base such as a hydroxide thereof, the alkaline earth metal being magnesium and/or calcium, or transmetallation of an alkali metal salt, the alkali metal being sodium, potassium, or the like, with a corresponding alkaline earth metal salt. Furthermore, the alkaline earth metal sulfonate, phenate, and salicylate also encompass a basic alkaline earth metal sulfonate, a basic alkaline earth metal phenate, and a basic alkaline earth metal salicylate, which are produced by heating the neutral alkaline earth metal sulfonate, neutral alkaline earth metal phenate, and neutral alkaline earth metal salicylate, with an excess amount of an alkaline earth metal salt or an alkaline earth metal base in the presence of water. Also, the alkaline earth metal sulfonate, phenate, and salicylate further encompass a perbasic alkaline earth metal sulfonate, a perbasic alkaline earth metal phenate, and a perbasic alkaline earth metal salicylate, which are produced by reacting the neutral alkaline earth metal sulfonate, neutral alkaline earth metal phenate, and neutral alkaline earth metal salicylate, with an alkaline earth metal carbonate or borate in the presence of carbonate gas.

In order to reduce sulfur components in the composition, the metallic detergent employed in the present invention is preferably an alkaline earth metal salicylate or an alkaline earth metal phenate. Among them, a perbasic salicylate and a perbasic phenate are preferred, with perbasic calcium salicylate being particularly preferred.

The metallic detergent employed in the present invention preferably has a total base value of 10 mgKOH/g to 500 mgKOH/g, more preferably 15 mgKOH/g to 450 mgKOH/g. These metallic detergent having such a total base value may be used singly or in combination of two or more species.

As used herein, the total base value is a total base value determined through the potentiometric titration method (base value/perchloric acid method) in accordance with JIS K 2501 "Petroleum products and lubricating oils—neutralization value test method" 7.

No particular limitation is imposed on the metal ratio of the metallic detergent employed in the present invention. Generally, one or more metallic detergents having a metal ratio of 20 or less can be used in combination. The metal ratio of the metallic detergent is preferably 3 or less, more preferably 1.5 or less, particularly preferably 1.2 or less, since excellent stability to oxidation, consistent base value, high-temperature detergency, etc. can be attained.

As used herein, the metal ratio of the metallic detergent is represented by valence of metal element×metal element content (mol %)/soap group content (mol %). The metal element refers to calcium, magnesium, etc., and the soap group refers to a sulfonate group, a phenol group, a salicylate group, etc.

The amount of the metallic detergent incorporated into the lubricating oil composition is preferably 0.01 mass % to 20 mass %, more preferably 0.1 mass % to 10 mass %, still more preferably 0.5 mass % to 5 mass %.

When the amount is 0.01 mass % or more, performances such as high-temperature detergency, stability to oxidation, and consistent base value can be readily attained, whereas when the amount is 20 mass % or less, effects commensurate to the amount of addition can be generally attained. Even when the above amount conditions are satisfied, it is important to control the upper limit of the amount of the metallic detergent to as low a level as possible. Through controlling the amount in such a manner, the metallic content; i.e., sulfated ash content, of the lubricating oil composition can be reduced, whereby deterioration of exhaust gas cleaner of automobiles can be prevented.

So long as the aforementioned amount conditions are satisfied, the metallic detergents may be used singly or in combination of two or more species.

Among the aforementioned metallic detergents, perbasic calcium salicylate or perbasic calcium phenate is preferred. Among the aforementioned ashless dispersants, polybutenylsuccinic acid bisimide is particularly preferred. The perbasic calcium salicylate and perbasic calcium phenate preferably has a total base value of 100 mgKOH/g to 500 mgKOH/g, more preferably 200 mgKOH/g to 500 mgKOH/g.

Examples of the viscosity index improver include polymethacrylate, dispersion-type polymethacrylate, olefin copolymers (e.g., ethylene-propylene copolymer), dispersion-type olefin copolymers, and styrene copolymers (e.g., styrene-diene copolymer and styrene-isoprene copolymer).

For attaining the viscosity index improver, the amount thereof is preferably 0.5 mass % to 15 mass % based on the total amount of the lubricating oil composition, more preferably 1 mass % to 10 mass %.

Examples of the pour point depressant include polymethacrylate having a mass average molecular weight of about 5,000 to about 50,000.

For attaining the pour point depressant, the amount thereof is preferably 0.1 mass % to 2 mass % based on the total amount of the lubricating oil composition, more preferably 0.1 mass % to 1 mass %.

Examples of the metal deactivator include benzotriazole compound, a tolyltriazole compound, a thiadiazole compound, and an imidazole compound.

The amount of the metal deactivator is preferably 0.01 mass % to 3 mass % based on the total amount of the lubricating oil composition, more preferably 0.01 mass % to 1 mass %.

Examples of the rust preventive include petroleum sulfonate, alkylbenzene sulfonate, dinonylnaphthalene sulfonate, alkenylsuccinic acid esters, and polyhydric alcohol esters.

For attaining the rust preventive, the amount thereof is preferably 0.01 mass % to 1 mass % based on the total amount of the lubricating oil composition, more preferably 0.05 mass % to 0.5 mass %.

Examples of the defoaming agent include silicone oil, fluorosilicone oil, and fluoroalkyl ether. From the viewpoints of defoaming effect, cost effectiveness, etc., the amount of defoaming agent is preferably 0.005 mass % to 0.5 mass % based on the total amount of the lubricating oil composition, more preferably 0.01 mass % to 0.2 mass %.

The lubricating oil composition of the present invention may further contain a friction modifier, an anti-wear agent, or an extreme pressure agent, in accordance with need. Notably, the friction modifier refers to a compound other than the polar-group-containing compound, which is an essential component of the present invention. The amount of friction modifier is preferably 0.01 mass % to 2 mass % based on the total amount of the lubricating oil composition, more preferably 0.01 mass % to 1 mass %.

Examples of the anti-wear agent or extreme pressure agent include sulfur-containing compounds such as zinc dithiophosphate, zinc phosphate, zinc dithiocarbamate, molybdenum dithiocarbamate, molybdenum dithiophosphate, disulfides, olefin sulfides, sulfidized oils, sulfidized esters, thiocarbonates, thiocarbamates, and polysulfides; phosphorus-containing compounds such as phosphite esters, phosphate esters, phosphonate esters, and amine salts or metal salts thereof; sulfur- and phosphorus-containing anti-wear agents such as thiophosphite esters, thiophosphate esters, thiophosphonate esters, and amine salts or metal salts thereof.

In the case where an anti-wear agent or an extreme pressure agent is incorporated into the lubricating oil composition, the amount thereof must be carefully regulated, so that the phosphorus content or the metal content of the lubricating oil does not excessively increase.

The lubricating oil composition of the present invention has the aforementioned compositional proportions and the following characteristics.

(1) Phosphorus content (JIS-5S-38-92) and sulfated ash content (JIS K2272) satisfy any of the following conditions A to C:

Condition A

Phosphorus content less than 0.03 mass % and sulfated ash content less than 0.3 mass %. In this case, the phosphorus content is preferably 0.02 mass % or less, and the sulfated ash content is preferably 0.25 mass % or less.

Condition B

Phosphorus content less than 0.03 mass % and sulfated ash content 0.3 mass % to 0.6 mass %. In this case, the phosphorus content is preferably 0.02 mass % or less, and the sulfated ash content is preferably 0.3 mass % to 0.5 mass %.

Condition C

Phosphorus content 0.03 mass % to 0.06 mass % and sulfated ash content less than 0.3 mass %. In this case, the phosphorus content is preferably 0.03 mass % to 0.055 mass %, and the sulfated ash content is preferably 0.25 mass % or less.

(2) Sulfur content (JIS K2541) is 0.10 mass % to 1.00 mass %, preferably 0.12 mass % to 0.90 mass %.

In addition to the above conditions, the following conditions are preferably satisfied.

(3) Nitrogen content (JIS K 2609) is preferably 0.08 mass % to 0.40 mass %, more preferably 0.08 mass % to 0.35 mass %.

(4) Boron content (JPI-5S-38-92) is preferably 0.020 mass % to 0.3 mass, more preferably 0.025 mass % to 0.25 mass %.

When the lubricating oil composition of the present invention having the aforementioned characteristics is applied to an engine having a sliding part formed of aluminum alloy, the composition can considerably reduce the high-phosphorus ZnDTP content and the metallic detergent content, while excellent wear resistance to aluminum alloy is maintained.

The lubricating oil composition of the present invention can be suitably used as a lubricating oil for internal combustion engines; such as gasoline engines, diesel engines, and gas engines, of two-wheeled vehicles, four-wheeled vehicles, power generation facilities, water vehicles, etc. By virtue of low phosphorus content, low sulfur content, and low sulfated ash content, the lubricating oil composition of the present invention is particularly suitable for internal combustion engines equipped with an exhaust gas cleaner.

EXAMPLES

The present invention will next be described in detail by way of Examples and Comparative Examples, which should not be construed as limiting the invention thereto.

<Determination of Properties and Performances>

In the following Examples and Comparative Examples, properties and performances of the lubricating oil compositions were determined through the following methods.

(1) Phosphorus Content

Determined in accordance with JPI-5S-38-92.

(2) Sulfur Content

Determined in accordance with JIS K 2541.

(3) Boron Content

Determined in accordance with JPI-5S-38-92.

(4) Sulfated Ash Content

Determined in accordance with JIS K 2272.

(5) Nitrogen Content

Determined in accordance with JIS K 2609.

(6) Wear Resistance Evaluation

A friction test was performed by means of an SRV friction tester (reciprocating kinetic friction tester) under the following conditions. Specifically, a ring-shape steel member was reciprocally moved against a disk, while the curved surface of the steel member was in contact with the disk, whereby friction between the two members was determined. The maximum kinetic friction coefficient during the test period was measured. Notably, when the kinetic friction coefficient is in excess of 0.3 during the test period, the disk-shape test piece considerably wears, resulting in problematic wear resistance.

—Test Conditions—

Test piece: ring-shape steel member (chromium-plated steel member, ring width: 1.5 mm), disk (Si-containing aluminum: AA (Aluminum Association of America) standard "A390")

Test temperature: 130° C.

Load: 100 N

Moving direction: width direction of the ring-shape steel member

Amplitude: 3.0 mm

Frequency: 20 Hz

Test period: 1 hr (test being stopped when kinematic friction coefficient exceeds 0.3)

Examples A1 to A16, and Comparative Examples A1 to A6

A base oil was blended with additives at the compositional proportions shown in Tables 1 and 2, to thereby prepare engine lubricating oil compositions. Tables 1 and 2 show properties and performances of the compositions.

TABLE 1

| | | Examples | | | | | | | |
|---|---|---|---|---|---|---|---|---|---|
| | | A1 | A2 | A3 | A4 | A5 | A6 | A7 | A8 |
| Content (mass %) | Base oil | bal | bal | bal | bal | bal | bal | bal | bal |
| | Boronated imide 1 | 8.0 | 8.0 | 8.0 | — | — | 8.0 | 8.0 | 8.0 |
| | Boronated imide 2 | — | — | — | 5.0 | 5.0 | — | — | — |
| | Non-boronated imide 1 | 2.0 | 2.0 | 2.0 | — | — | 2.0 | 2.0 | 2.0 |
| | Non-boronated imide 2 | — | — | — | 15.0 | 15.0 | — | — | — |
| | Compound A | 0.6 | 1.2 | 1.8 | 0.6 | 1.2 | — | — | — |
| | Compound B | — | — | — | — | — | 0.8 | 1.2 | 1.6 |
| | Compound C | — | — | — | — | — | — | — | — |
| | Compound D | — | — | — | — | — | — | — | — |
| | Compound E | — | — | — | — | — | — | — | — |
| | Compound F | — | — | — | — | — | — | — | — |
| | Compound G | — | — | — | — | — | — | — | — |
| | P-antiwear agent | — | — | — | — | — | — | — | — |
| | Other additives | 2.15 | 2.15 | 2.15 | 7.25 | 7.25 | 2.15 | 2.15 | 2.15 |
| Properties (mass %) | S content | 0.25 | 0.50 | 0.75 | 0.25 | 0.50 | 0.20 | 0.40 | 0.60 |
| | N content: dispersant | 0.20 | 0.20 | 0.20 | 0.22 | 0.22 | 0.20 | 0.20 | 0.20 |
| | B content: dispersant | 0.16 | 0.16 | 0.16 | 0.06 | 0.06 | 0.16 | 0.16 | 0.16 |
| | B/N ratio | 0.8 | 0.8 | 0.8 | 0.27 | 0.27 | 0.8 | 0.8 | 0.8 |
| | P content | 0.00 | 0.00 | 0.00 | 0.00 | 0.00 | 0.00 | 0.00 | 0.00 |
| | Sulfated ash content | 0.10 | 0.10 | 0.10 | 0.04 | 0.04 | 0.10 | 0.10 | 0.10 |
| Evaluation | SRV test | 0.166 | 0.166 | 0.166 | 0.150 | 0.150 | 0.161 | 0.158 | 0.154 |
| | Kinetic friction coeff. μ | | | | | | | | |

| | | Examples | | | | | | | |
|---|---|---|---|---|---|---|---|---|---|
| | | A9 | A10 | A11 | A12 | A13 | A14 | A15 | A16 |
| Content (mass %) | Base oil | bal | bal | bal | bal | bal | bal | bal | bal |
| | Boronated imide 1 | 8.0 | — | 8.0 | 8.0 | 8.0 | 4.0 | 23 | 16.8 |
| | Boronated imide 2 | — | 5.0 | — | — | — | — | — | — |
| | Non-boronated imide 1 | 2.0 | — | 2.0 | 2.0 | 2.0 | — | — | 4.2 |
| | Non-boronated imide 2 | — | 15.0 | — | — | — | — | — | — |
| | Compound A | — | — | — | — | — | 1.2 | 1.8 | 1.8 |
| | Compound B | — | — | — | — | — | — | — | — |
| | Compound C | 1.2 | 1.2 | — | — | — | — | — | — |
| | Compound D | — | — | 1.2 | — | — | — | — | — |
| | Compound E | — | — | — | 1.2 | — | — | — | — |
| | Compound F | — | — | — | — | 0.6 | — | — | — |
| | Compound G | — | — | — | — | — | — | — | — |
| | P-antiwear agent | — | — | — | — | — | — | — | — |
| | Other additives | 2.15 | 7.25 | 2.15 | 2.15 | 2.15 | 2.15 | 2.15 | 2.15 |

TABLE 1-continued

| | | | | | | | | | |
|---|---|---|---|---|---|---|---|---|---|
| Properties (mass %) | S content | 0.24 | 0.24 | 0.22 | 0.24 | 0.25 | 0.50 | 0.75 | 0.75 |
| | N content: dispersant | 0.20 | 0.22 | 0.20 | 0.20 | 0.20 | 0.07 | 0.41 | 0.42 |
| | B content: dispersant | 0.16 | 0.06 | 0.16 | 0.16 | 0.16 | 0.08 | 0.48 | 0.34 |
| | B/N ratio | 0.8 | 0.27 | 0.8 | 0.8 | 0.8 | 1.14 | 0.17 | 0.81 |
| | P content | 0.00 | 0.00 | 0.00 | 0.00 | 0.00 | 0.00 | 0.00 | 0.00 |
| | Sulfated ash content | 0.10 | 0.04 | 0.10 | 0.10 | 0.10 | 0.05 | 0.10 | 0.10 |
| Evaluation | SRV test Kinetic friction coeff. μ | 0.155 | 0.122 | 0.205 | 0.163 | 0.164 | 0.210 | 0.220 | 0.224 |

TABLE 2

| | | Comparative Examples | | | | | |
|---|---|---|---|---|---|---|---|
| | | A1 | A2 | A3 | A4 | A5 | A6 |
| Content (mass %) | Base oil | bal | bal | bal | bal | bal | bal |
| | Boronated imide 1 | 8.0 | 8.0 | — | 8.0 | 8.0 | 8.0 |
| | Boronated imide 2 | — | — | 5.0 | — | — | — |
| | Non-boronated imide 1 | 2.0 | 2.0 | — | 2.0 | 2.0 | 2.0 |
| | Non-boronated imide 2 | — | — | 15.0 | — | — | — |
| | Compound A | — | — | — | — | — | 0.22 |
| | Compound B | — | — | — | — | — | — |
| | Compound C | — | — | — | — | — | — |
| | Compound D | — | — | — | — | — | — |
| | Compound E | — | — | — | — | — | — |
| | Compound F | — | — | — | — | — | — |
| | Compound G | 1.0 | 2.9 | 1.0 | 0.2 | 1.2 | — |
| | P-antiwear agent | — | — | — | 0.20 | — | — |
| | Other additives | 2.15 | 2.15 | 7.25 | 2.15 | 2.15 | 2.15 |
| Properties (mass %) | S content | 0.20 | 0.58 | 0.20 | 0.08 | 0.24 | 0.09 |
| | N content: dispersant | 0.20 | 0.20 | 0.24 | 0.20 | 0.20 | 0.21 |
| | B content: dispersant | 0.16 | 0.16 | 0.06 | 0.16 | 0.16 | 0.16 |
| | B/N ratio | 0.8 | 0.8 | 0.25 | 0.8 | 0.8 | 0.76 |
| | P content | 0.00 | 0.00 | 0.00 | 0.016 | 0.00 | 0.00 |
| | Sulfated ash content | 0.14 | 0.14 | 0.14 | 0.14 | 0.14 | 0.14 |
| Evaluation | SRV test Kinetic friction coeff. μ | 0.3< | 0.3< | 0.3< | 0.3< | 0.3< | 0.3< |

Ingredients used for preparing lubricating oil compositions shown in Tables 1 and 2 are as follows.

Base oil: hydro-refined mineral oil (100 N, kinematic viscosity at 40° C.: 21.0 $mm^2/s$, kinematic viscosity at 100° C.: 4.5 $mm^2/s$, viscosity index: 127, and sulfur content: <5 ppm by mass)

Boronated imide 1 (polybutenylsuccinic acid monoimide boride, number average molecular weight of polybutenyl group: 950, base value (perchloric acid method): 30.6 mgKOH/g, nitrogen content: 1.8 mass %, and boron content: 2.1 mass %)

Boronated imide 2 (polybutenylsuccinic acid bisimide boride, number average molecular weight of polybutenyl group: 950, base value (perchloric acid method): 25 mgKOH/g, nitrogen content: 1.2 mass %, and boron content: 1.3 mass %)

Non-boronated imide 1 (polybutenylsuccinic acid monoimide, number average molecular weight of polybutenyl group: 950, base value (perchloric acid method): 44 mgKOH/g, and nitrogen content: 2.1 mass %)

Non-boronated imide 2 (polybutenylsuccinic acid bisimide, number average molecular weight of polybutenyl group: 1,300, base value (perchloric acid method): 11.9 mgKOH/g, and nitrogen content: 1.0 mass %)

Compound A (compound represented by formula (I-a))

Compound B (compound represented by formula (I-b))

Compound C (compound represented by formula (I-c))

Compound D (compound represented by formula (I-d))

Compound E (compound represented by formula (I-e))

Compound F (compound represented by formula (I-f))

Compound G (bis(n-octoxycarbonylmethyl)disulfide, sulfur content: 158 ppm by mass)

Phosphorus-based anti-wear agent (zinc dithioalkyldithiophosphate (alkyl groups: mixture of sec-butyl and sec-hexyl), Zn content: 9.0 mass %, phosphorus content: 8.0 mass %, and sulfur content: 17.1 mass %)

Other additives: mixture of antioxidant (phenol-based antioxidant and amine-based antioxidant), metal deactivator (alkylbenzotriazole), and defoaming agent (silicone).

Tables 1 and 2 shows the following.

The lubricating oil composition of the present invention containing a thioheterocyclic compound represented by formula (I) exhibited small kinetic friction coefficient to an aluminum member, indicating excellent wear resistance (Examples A1 to A16). In particular, the lubricating oil compositions of Examples A6 to A8, containing a thioheterocyclic compound represented by formula (I-b) exhibited a wear resistance to an aluminum member which is considerably higher than those of lubricating oil compositions of the other Examples containing an equiamount of another thioheterocyclic compound.

In contrast, lubricating oil compositions having considerably low sulfur content or containing an sulfur-based anti-wear agent other than the thioheterocyclic compound represented by formula (I) exhibited poor wear resistance to an aluminum member (Comparative Examples A1 to A6).

Examples B1 to B11, and Comparative Examples B1 to B6

A base oil was blended with additives at the compositional proportions shown in Tables 3 and 4, to thereby prepare engine lubricating oil compositions. Tables 3 and 4 show properties and performances of the compositions.

TABLE 3

| | | Examples | | | | | | | | | | |
|---|---|---|---|---|---|---|---|---|---|---|---|---|
| | | B1 | B2 | B3 | B4 | B5 | B6 | B7 | B8 | B9 | B10 | B11 |
| Content (mass %) | Base oil | bal | bal | bal | bal | bal | bal | bal | bal | bal | bal | bal |
| | Boronated imide 1 | 8.0 | 8.0 | 8.0 | 8.0 | 8.0 | 8.0 | 8.0 | 8.0 | 4.0 | 23 | 16.8 |
| | Boronated imide 2 | — | — | — | — | — | — | — | — | — | — | — |

TABLE 3-continued

| | | Examples | | | | | | | | | | |
|---|---|---|---|---|---|---|---|---|---|---|---|---|
| | | B1 | B2 | B3 | B4 | B5 | B6 | B7 | B8 | B9 | B10 | B11 |
| | Non-boronated imide 1 | 2.0 | 2.0 | 2.0 | 2.0 | 2.0 | 2.0 | 2.0 | 2.0 | — | — | 4.2 |
| | Non-boronated imide 2 | — | — | — | — | — | — | — | — | — | — | — |
| | Compound A | 0.6 | 1.2 | 1.8 | — | — | — | — | — | 1.2 | 1.8 | 1.8 |
| | Compound B | — | — | — | 1.2 | — | — | — | — | — | — | — |
| | Compound C | — | — | — | — | 1.2 | — | — | — | — | — | — |
| | Compound D | — | — | — | — | — | 1.2 | — | — | — | — | — |
| | Compound E | — | — | — | — | — | — | 1.2 | — | — | — | — |
| | Compound F | — | — | — | — | — | — | — | 0.6 | — | — | — |
| | Compound G | — | — | — | — | — | — | — | — | — | — | — |
| | Metallic detergent | 0.6 | 0.6 | 0.6 | 0.6 | 0.6 | 0.6 | 0.6 | 0.6 | 0.6 | 0.6 | 0.6 |
| | P-antiwear agent | — | — | — | — | — | — | — | | | | |
| | Other additives | 2.15 | 2.15 | 2.15 | 2.15 | 2.15 | 2.15 | 2.15 | 2.15 | 2.15 | 2.15 | 2.15 |
| Properties | S content | 0.25 | 0.50 | 0.75 | 0.40 | 0.24 | 0.22 | 0.24 | 0.25 | 0.50 | 0.75 | 0.75 |
| (mass %) | N content: dispersant | 0.20 | 0.20 | 0.20 | 0.20 | 0.20 | 0.20 | 0.20 | 0.20 | 0.07 | 0.41 | 0.42 |
| | B content: dispersant | 0.16 | 0.16 | 0.16 | 0.16 | 0.16 | 0.16 | 0.16 | 0.16 | 0.08 | 0.48 | 0.34 |
| | B/N ratio | 0.8 | 0.8 | 0.8 | 0.8 | 0.8 | 0.8 | 0.8 | 0.8 | 1.14 | 1.17 | 0.81 |
| | P content | 0.00 | 0.00 | 0.00 | 0.00 | 0.00 | 0.00 | 0.00 | 0.00 | 0.00 | 0.00 | 0.00 |
| | Sulfated ash content | 0.30 | 0.30 | 0.30 | 0.30 | 0.30 | 0.30 | 0.30 | 0.30 | 0.30 | 0.30 | 0.30 |
| Evaluation | SRV test Kinetic friction coeff. μ | 0.166 | 0.164 | 0.170 | 0.164 | 0.160 | 0.188 | 0.166 | 0.164 | 0.208 | 0.212 | 0.214 |

TABLE 4

| | | Comparative Examples | | | | | |
|---|---|---|---|---|---|---|---|
| | | B1 | B2 | B3 | B4 | B5 | B6 |
| Content | Base oil | bal | bal | bal | bal | bal | bal |
| (mass %) | Boronated imide 1 | 8.0 | 8.0 | — | 8.0 | 8.0 | 8.0 |
| | Boronated imide 2 | — | — | 5.0 | — | — | — |
| | Non-boronated imide 1 | 2.0 | 2.0 | — | 2.0 | 2.0 | 2.0 |
| | Non-boronated imide 2 | — | — | 15.0 | — | — | — |
| | Compound A | — | — | — | — | — | 0.22 |
| | Compound B | — | — | — | — | — | — |
| | Compound C | — | — | — | — | — | — |
| | Compound D | — | — | — | — | — | — |
| | Compound E | — | — | — | — | — | — |
| | Compound F | — | — | — | — | — | — |
| | Compound G | 1.0 | 2.9 | 1.0 | 0.2 | 1.2 | — |
| | Metallic detergent | — | — | — | 0.6 | 0.6 | 0.6 |
| | P-antiwear agent | — | — | — | — | — | — |
| | Other additives | 2.15 | 2.15 | 7.25 | 2.15 | 2.15 | 2.15 |
| Properties | S content | 0.20 | 0.58 | 0.20 | 0.08 | 0.24 | 0.09 |
| (mass %) | N content: dispersant | 0.20 | 0.20 | 0.24 | 0.20 | 0.20 | 0.21 |
| | B content: dispersant | 0.16 | 0.16 | 0.06 | 0.16 | 0.16 | 0.16 |
| | B/N ratio | 0.8 | 0.8 | 0.25 | 0.8 | 0.8 | 0.76 |
| | P content | 0.00 | 0.00 | 0.00 | 0.00 | 0.00 | 0.00 |
| | Sulfated ash content | 0.10 | 0.10 | 0.04 | 0.30 | 0.30 | 0.30 |
| Evaluation | SRV test Kinetic friction coeff. μ | 0.3< | 0.3< | 0.3< | 0.3< | 0.3< | 0.3< |

Other than metallic detergents, ingredients used for preparing lubricating oil compositions shown in Tables 3 and 4 are the same as shown in Tables 1 and 2.

The following metallic detergent was used.

Metallic detergent (Ca salicylate, base value (perchloric acid method): 270 mgKOH/g)

Tables 3 and 4 shows the following.

The lubricating oil composition of the present invention containing a thioheterocyclic compound represented by formula (I) exhibited small kinetic friction coefficient to an aluminum member, indicating excellent wear resistance (Examples B1 to B11). In particular, the lubricating oil composition of Example B4, containing a thioheterocyclic compound represented by formula (I-b) exhibited remarkably high wear resistance to an aluminum member.

In contrast, lubricating oil compositions having considerably low sulfur content or containing an sulfur-based anti-wear agent other than the thioheterocyclic compound represented by formula (I) exhibited poor wear resistance to an aluminum member (Comparative Examples B1 to B6).

Examples C1 to C11, and Comparative Examples C1 to C6

A base oil was blended with additives at the compositional proportions shown in Tables 5 and 6, to thereby prepare engine lubricating oil compositions. Tables 5 and 6 show properties and performances of the compositions.

TABLE 5

| | | Examples | | | | | | | | | | |
|---|---|---|---|---|---|---|---|---|---|---|---|---|
| | | C1 | C2 | C3 | C4 | C5 | C6 | C7 | C8 | C9 | C10 | C11 |
| Content | Base oil | bal | bal | bal | bal | bal | bal | bal | bal | bal | bal | bal |
| (mass %) | Boronated imide 1 | 8.0 | 8.0 | 8.0 | 8.0 | 8.0 | 8.0 | 8.0 | 8.0 | 4.0 | 23 | 16.8 |
| | Boronated imide 2 | — | — | — | — | — | — | — | — | — | — | — |
| | Non-boronated imide 1 | 2.0 | 2.0 | 2.0 | 2.0 | 2.0 | 2.0 | 2.0 | 2.0 | — | — | 4.2 |
| | Non-boronated imide 2 | — | — | — | — | — | — | — | — | — | — | — |
| | Compound A | 0.6 | 1.2 | 1.8 | — | — | — | — | — | 1.2 | 1.8 | 1.8 |

TABLE 5-continued

| | | Examples | | | | | | | | | | |
|---|---|---|---|---|---|---|---|---|---|---|---|---|
| | | C1 | C2 | C3 | C4 | C5 | C6 | C7 | C8 | C9 | C10 | C11 |
| | Compound B | — | — | — | 1.2 | — | — | — | — | — | — | — |
| | Compound C | — | — | — | — | 1.2 | — | — | — | — | — | — |
| | Compound D | — | — | — | — | — | 1.2 | — | — | — | — | — |
| | Compound E | — | — | — | — | — | — | 1.2 | — | — | — | — |
| | Compound F | — | — | — | — | — | — | — | 0.6 | — | — | — |
| | Compound G | — | — | — | — | — | — | — | — | — | — | — |
| | P-antiwear agent | 0.38 | 0.38 | 0.38 | 0.38 | 0.38 | 0.38 | 0.38 | 0.38 | 0.38 | 0.38 | 0.38 |
| | Other additives | 2.15 | 2.15 | 2.15 | 2.15 | 2.15 | 2.15 | 2.15 | 2.15 | 2.15 | 2.15 | 2.15 |
| Properties | S content | 0.29 | 0.54 | 0.79 | 0.44 | 0.28 | 0.26 | 0.28 | 0.29 | 0.54 | 0.79 | 0.79 |
| (mass %) | N content: dispersant | 0.20 | 0.20 | 0.20 | 0.20 | 0.20 | 0.20 | 0.20 | 0.20 | 0.07 | 0.41 | 0.42 |
| | B content: dispersant | 0.16 | 0.16 | 0.16 | 0.16 | 0.16 | 0.16 | 0.16 | 0.16 | 0.08 | 0.48 | 0.34 |
| | B/N ratio | 0.8 | 0.8 | 0.8 | 0.8 | 0.8 | 0.8 | 0.8 | 0.8 | 1.14 | 1.17 | 0.81 |
| | P content | 0.03 | 0.03 | 0.03 | 0.03 | 0.03 | 0.03 | 0.03 | 0.03 | 0.03 | 0.03 | 0.03 |
| | Sulfated ash content | 0.14 | 0.14 | 0.14 | 0.14 | 0.14 | 0.14 | 0.14 | 0.14 | 0.14 | 0.14 | 0.14 |
| Evaluation | SRV test Kinetic friction coeff. μ | 0.164 | 0.162 | 0.166 | 0.158 | 0.155 | 0.182 | 0.160 | 0.160 | 0.204 | 0.214 | 0.212 |

TABLE 6

| | | Comparative Examples | | | | | |
|---|---|---|---|---|---|---|---|
| | | C1 | C2 | C3 | C4 | C5 | C6 |
| Content | Base oil | bal | bal | bal | bal | bal | bal |
| (mass %) | Boronated imide 1 | 8.0 | 8.0 | — | 8.0 | 8.0 | 8.0 |
| | Boronated imide 2 | — | — | 5.0 | — | — | — |
| | Non-boronated imide 1 | 2.0 | 2.0 | — | 2.0 | 2.0 | 2.0 |
| | Non-boronated imide 2 | — | — | 15.0 | — | — | — |
| | Compound A | — | — | — | — | — | 0.22 |
| | Compound B | — | — | — | — | — | — |
| | Compound C | — | — | — | — | — | — |
| | Compound D | — | — | — | — | — | — |
| | Compound E | — | — | — | — | — | — |
| | Compound F | — | — | — | — | — | — |
| | Compound G | 1.0 | 2.9 | 1.0 | 0.2 | 1.2 | — |
| | P-antiwear agent | — | — | — | 0.20 | 0.38 | 0.38 |
| | Other additives | 2.15 | 2.15 | 7.25 | 2.15 | 2.15 | 2.15 |
| Properties | S content | 0.20 | 0.58 | 0.20 | 0.08 | 0.24 | 0.09 |
| (mass %) | N content: dispersant | 0.20 | 0.20 | 0.24 | 0.20 | 0.20 | 0.21 |
| | B content: dispersant | 0.16 | 0.16 | 0.06 | 0.16 | 0.16 | 0.16 |
| | B/N ratio | 0.8 | 0.8 | 0.25 | 0.8 | 0.8 | 0.76 |
| | P content | 0.00 | 0.00 | 0.00 | 0.016 | 0.03 | 0.03 |
| | Sulfated ash content | 0.14 | 0.14 | 0.14 | 0.14 | 0.14 | 0.14 |
| Evaluation | SRV test Kinetic friction coeff. μ | 0.3< | 0.3< | 0.3< | 0.3< | 0.3< | 0.3< |

The ingredients used for preparing lubricating oil compositions shown in Tables 5 and 6 are the same as shown in Tables 1 and 2.

Tables 5 and 6 shows the following.

The lubricating oil composition of the present invention containing a thioheterocyclic compound represented by formula (I) exhibited small kinetic friction coefficient to an aluminum member, indicating excellent wear resistance (Examples C1 to C11). In particular, the lubricating oil composition of Example C4, containing a thioheterocyclic compound represented by formula (I-b) exhibited remarkably high wear resistance to an aluminum member.

In contrast, lubricating oil compositions containing no phosphorus-based anti-wear agent or containing an sulfur-based anti-wear agent other than the thioheterocyclic compound represented by formula (I) exhibited poor wear resistance to an aluminum member (Comparative Examples C1 to C6).

INDUSTRIAL APPLICABILITY

The lubricating oil composition for engine made of aluminum alloy of the present invention exhibits excellent wear resistance to aluminum members and can considerably reduce the high-phosphorus ZnDTP content and the metallic detergent content, while excellent wear resistance to aluminum members is maintained.

Thus, the composition of the present invention can be suitably used as a lubricating oil composition for engine which can reduce adverse effects on an aluminum-made exhaust gas treatment apparatus of an internal combustion engine.

The invention claimed is:

1. A lubricating oil composition, comprising:

a base oil;

a first succinimide compound;

a second succinimide compound; and a thioheterocyclic compound represented by formula (I):

$$(R^1)_k—(S)_m-A_S-(S)_n—(R^2)_l \quad (I)$$

where $A_S$ is a 1,3,4-thiadiazole ring;

$(S)_m$ and $(S)_n$ are bonded to the 1,3,4-thiadiazole ring at the 2-position and the 5-position, respectively;

each of $R^1$ and $R^2$ independently represents a hydrogen atom, an amino group, and a C1 to C50 group selected from the group consisting of an alkyl group, a cycloalkyl group, an alkenyl group, a cycloalkenyl group, and an aryl group, the C1 to C50 group optionally including at least one oxygen, nitrogen, or sulfur heteroatom;

each of k, l, m, and n is an integer of 1 to 5;

wherein:

the first succinimide compound comprises at least one of an alkenylsuccinimide and an alkylsuccinimide;

the second succinimide compound comprises at least one of a modified alkenylsuccinimide and a modified alkylsuccinimide;

the second succinimide compound is modified with at least one of a boron compound and an organic acid;

a boron content of the composition is 0.06 to 0.3 mass % based on a total mass of the composition;

a ratio by mass of boron to nitrogen (B/N) in the composition is 0.25 to 1.0;

a sulfur content of the composition is 0.10 mass % to 1.00 mass % based on a total mass of the composition; and a phosphorus content represented by P in mass % and a sulfated ash content represented by M in mass %, based on the total mass of the composition, satisfy any of conditions A to C:

condition A: $P<0.03$, and $M<0.3$;

condition B: $P<0.03$, and $0.3\leq M\leq 0.6$; and condition C: $0.03\leq P\leq 0.06$, and $M<0.3$.

2. The composition according to claim 1, wherein a nitrogen content attributed to the succinimide compound is from 0.08 mass % to 0.40 mass %, based on the total mass of the composition.

3. The composition according to claim 2, wherein the second succinimide compound is modified with a boron compound.

4. A method for lubricating an engine made of aluminum alloy, the method comprising:

applying, to a sliding part of the engine, the composition according to claim 1, wherein the sliding part is made of aluminum alloy.

5. The composition according to claim 1, wherein the thioheterocyclic compound is selected from the group consisting of 2,5-bis(t-nonylthio)-1,3,4-thiadiazole, 2,5-bis(dimethylhexylthio)-1,3,4-thiadiazole, 2,5-bis(octadecenylthio)-1,3,4-thiadiazole, 2,5-bis(methylhexadecenylthio)-1,3,4-thiadiazole, 2,5-bis(2-hydroxyoctadecylthio)-1,3,4-thiadiazole, 2,5-bis(n-octoxycarbonylmethylthio)-1,3,4-thiadiazole, 2,5-bis(dimethylhexyldithio)-1,3,4-thiadiazole, 2,5-bis(octadecenyldithio)-1,3,4-thiadiazole, 2,5-bis(methylhexadecenyldithio)-1,3,4-thiadiazole, 2,5-bis(2-hydroxyoctadecyldithio)-1,3,4-thiadiazole, and 2,5-bis(n-octoxycarbonylmethyldithio)-1,3,4-thiadiazole.

6. The composition according to claim 1, further comprising 0.5 to 5 mass % of a metallic detergent.

7. The composition according to claim 1, further comprising a phosphorus anti-wear agent.

8. The composition according to claim 1, wherein a phosphorus content represented by P in mass % and a sulfated ash content represented by M in mass %, based on the total mass of the composition, satisfy condition A or B:

condition A: $P<0.03$, and $M<0.3$; and condition B: $P<0.03$, and $0.3\leq M\leq 0.6$.

9. The composition according to claim 1, wherein the thioheterocyclic compound comprises at least one of 2,5-bis(t-nonylthio)-1,3,4-thiadiazole, 2,5-bis(dimethylhexylthio)-1,3,4-thiadiazole, 2,5-bis(dimethylhexyldithio)-1,3,4-thiadiazole, and a compound of formula (1-b):

(I-b)

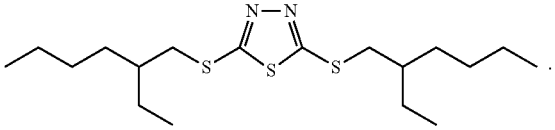

10. The composition according to claim 1, wherein the thioheterocyclic compound comprises at least one of 2,5-bis(octadecenylthio)-1,3,4-thiadiazole, 2,5-bis(methylhexadecenylthio)-1,3,4-thiadiazole, 2,5-bis(2-hydroxyoctadecylthio)-1,3,4-thiadiazole, 2,5-bis(n-octoxycarbonylmethylthio)-1,3,4-thiadiazole, 2,5-bis(octadecenyldithio)-1,3,4-thiadiazole, 2,5-bis(methylhexadecenyldithio)-1,3,4-thiadiazole, 2,5-bis(2-hydroxyoctadecyldithio)-1,3,4-thiadiazole, 2,5-bis(n-octoxycarbonylmethyldithio)-1,3,4-thiadiazole, and a compound of formula (1-e):

(I-e)

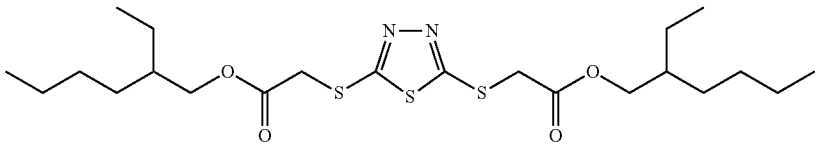

* * * * *